US007807590B2

(12) United States Patent
Takeuchi et al.

(10) Patent No.: US 7,807,590 B2
(45) Date of Patent: Oct. 5, 2010

(54) ISOTROPIC PITCH-BASED CARBON FIBER SPUN YARN, COMPOSITE YARN AND FABRIC USING THE SAME, AND MANUFACTURING METHODS THEREOF

(75) Inventors: Akira Takeuchi, Gamagori (JP); Tatsuo Kobayashi, Iwaki (JP)

(73) Assignee: Kureha Corporation, Tokyo (JP)

( * ) Notice: Subject to any disclaimer, the term of this patent is extended or adjusted under 35 U.S.C. 154(b) by 887 days.

(21) Appl. No.: 10/593,902

(22) PCT Filed: Mar. 22, 2005

(86) PCT No.: PCT/JP2005/005159

§ 371 (c)(1),
(2), (4) Date: Sep. 22, 2006

(87) PCT Pub. No.: WO2005/090664

PCT Pub. Date: Sep. 29, 2005

(65) Prior Publication Data

US 2007/0190883 A1 Aug. 16, 2007

(30) Foreign Application Priority Data

Mar. 22, 2004 (JP) ..... 2004-083149

(51) Int. Cl.

| | |
|---|---|
| ***D03D 15/00*** | (2006.01) |
| ***B32B 5/26*** | (2006.01) |
| ***B32B 27/00*** | (2006.01) |
| ***D02G 3/02*** | (2006.01) |

(52) U.S. Cl. ..... 442/301; 442/35; 442/51; 28/168; 28/170; 428/394; 428/395; 428/364; 57/236

(58) Field of Classification Search ..... 442/301; 428/364, 365, 367, 378, 395, 359, 371, 373, 428/374, 408; 156/148, 151, 229, 276; 57/3, 57/5, 9, 10, 11, 13, 210–235
See application file for complete search history.

(56) References Cited

U.S. PATENT DOCUMENTS

| | | | | |
|---|---|---|---|---|
| 4,552,329 | A * | 11/1985 | Hattori et al. | 249/134 |
| 5,030,435 | A * | 7/1991 | Kitamura et al. | 423/447.4 |
| 5,228,175 | A * | 7/1993 | Olry et al. | 28/168 |
| 5,994,261 | A * | 11/1999 | Tai et al. | 502/430 |
| 6,051,313 | A | 4/2000 | Olry et al. | |
| 6,585,842 | B1 * | 7/2003 | Bompard et al. | 156/166 |
| 6,800,364 | B2 * | 10/2004 | Chiu et al. | 428/327 |

FOREIGN PATENT DOCUMENTS

| | | |
|---|---|---|
| JP | S59-228068 | 12/1984 |
| JP | 02-293436 | 12/1990 |
| JP | 2002-054039 | 2/2002 |
| JP | 2003-109616 | 4/2003 |

OTHER PUBLICATIONS

Complete Textile Glossary, Celanese Acetate LLC, 2001, p. 150.*
International Search Report.

* cited by examiner

*Primary Examiner*—D. Lawrence Tarazano
*Assistant Examiner*—Altrev C Sykes
(74) *Attorney, Agent, or Firm*—Reed Smith LLP

(57) ABSTRACT

A method of manufacturing an isotropic pitch-based carbon fiber spun yarn fabric includes the following steps of: obtaining composite yarn by winding a water-soluble polymer fiber around a surface of isotropic pitch-based carbon fiber spun yarn; obtaining a composite yarn fabric by weaving the composite yarn; and obtaining the isotropic pitch-based carbon fiber spun yarn fabric by dissolving and removing the water-soluble polymer fiber from the composite yarn fabric.

20 Claims, 3 Drawing Sheets

ISOTROPIC PITCH-BASED CARBON FIBER SPUN YARN, COMPOSITE YARN AND FABRIC USING THE SAME, AND MANUFACTURING METHODS THEREOF

TECHNICAL FIELD

The present invention relates to carbon fiber spun yarn using isotropic pitch-based carbon fibers as a starting material, composite yarn and fabric using the same, and manufacturing methods thereof.

BACKGROUND OF THE INVENTION

Carbon fibers mainly used are divided into PAN-based carbon fibers mainly using acrylic fibers (PAN fibers) as a starting material, and pitch-based carbon fibers using pitches as a starting material. Among them, the PAN-based carbon fibers are utilized mainly in the form of long fibers as it is difficult to obtain spun yarn having high tensile strength in a case of using short fibers, which are only impregnated with a sizing agent and applied to fabrics by use of a high-speed loom. However, despite good performances thereof, those fabrics have a problem of limited applications due to reasons such as high prices thereof.

On the other hand, the pitch-based carbon fibers are divided into anisotropic pitch-based carbon fibers and isotropic pitch-based carbon fibers. The anisotropic pitch-based carbon fibers possess crystal perfection and a highly oriented structure of a hexagonal net plane in the direction of fiber axis that lead to a high elastic modulus and insufficient flexibility, and therefore, the anisotropic pitch-based carbon fibers have a problem of difficulty in weaving with a high-speed loom.

Meanwhile, the isotropic pitch-based carbon fibers are generally manufactured as low-cost and highly productive short fibers, and the short fibers intertwine relatively favorably in a spinning process due to a lower elastic modulus thereof as compared to the anisotropic pitch-based carbon fibers. However, since the single fiber has low tensile strength and is weak against bending or twisting and the number of twist thereof is also fewer than cotton yarn or the like, spun yarn having high tensile strength cannot be obtained.

Therefore, it is difficult to perform weaving with a high-speed loom only by impregnating a sizing agent because a trouble such as breaking spun yarn may be incurred. For this reason, fabrics have been conventionally manufactured with a low-speed shuttle loom by necessity.

Moreover, ends of the short fibers constituting the isotropic pitch-based carbon fiber spun yarn are fluffy. Accordingly, fluff is broken due to friction with guides, rollers, and the like through a spinning or weaving process and is apt to fly apart. Thus, there is a problem of broken carbon fiber dust rising inside a factory as drifting dust that leads to significant deterioration in work environments.

Meanwhile, the conventional isotropic pitch-based carbon fiber spun yarn fabric is obtained by spinning the short fibers and subsequently by weaving the spun yarn with a low-speed shuttle loom. However, spun yarn having a large diameter is used because the number of fibers is generally increased in order to provide the spun yarn with weavable strength. For this reason, the fabric thus obtained has poor flexibility and has a problem of limited applications due to a reason that it is difficult to form a member in a complicated shape.

Under these circumstances, Japanese Unexamined Patent Application Publication No. 2002-54039 (Document 1), for instance, discloses untwisted yarn configured to wind splicing yarn made of cationic dye-dyeable polyester spirally around an outer periphery of a virtually untwisted fiber bundle. The specification (Paragraph 0016) describes that "the filament yarn is dissolved in an alkaline aqueous solution but not in water; therefore, the untwisted yarn of the present invention can employ a water-related process freely in a manufacturing process before completion of weaving." Nevertheless, methods disclosed in conventional documents like this is not cannot thoroughly resolve the above-described problems of the isotropic pitch-based carbon fiber spun yarn and the fabric thereof.

DISCLOSURE OF THE INVENTION

The present invention has been made in consideration of the problems of the prior art. An object (a first object) of the present invention is to provide composite yarn and a fabric using isotropic pitch-based carbon fiber spun yarn, and manufacturing methods thereof, the composite yarn and the fabric being capable of high-speed weaving while sufficiently preventing occurrence of thread breakage at the time of high-speed weaving and also capable of improving a work environment while preventing generation of dust at the time of manufacturing.

Another object (a second object) of the present invention is to provide isotropic pitch-based carbon fiber spun yarn suitable for original yarn of an isotropic pitch-based carbon fiber spun yarn fabric and a manufacturing method thereof, the spun yarn being capable of high-speed weaving while sufficiently preventing occurrence of thread breakage at the time of high-speed weaving and also being capable of improving a work environment while preventing generation of dust at the time of manufacturing.

As a result of extensive studies to attain the foregoing objects, the inventors of the present invention have found out that the first object is achieved by winding a water-soluble polymer fiber around a surface of spun yarn and dissolving and removing the water-soluble polymer fiber after weaving in the course of obtaining composite yarn made of the isotropic pitch-based carbon fiber spun yarn and a fabric using the same, and thus have accomplished the present invention.

Moreover, the inventors of the present invention have found out that the second object is achieved by removing fine carbon fibers and aggregates thereof from the isotropic pitch-based carbon fiber spun yarn obtained by spinning an isotropic pitch-based carbon fiber sliver by a specific method and thereby setting the size and the number of the fine carbon fiber aggregates contained in the spun yarn equal to or below predetermined values. Accordingly, the inventors have come to accomplish the present invention.

The isotropic pitch-based carbon fiber spun yarn fabric of the present invention is formed by dissolving and removing a water-soluble polymer fiber from a composite yarn fabric which is made by weaving composite yarn including isotropic pitch-based carbon fiber spun yarn and the water-soluble polymer fiber wound around a surface of the spun yarn.

Moreover, the composite yarn of the present invention includes isotropic pitch-based carbon spun yarn and a water-soluble polymer fiber wound around a surface of the spun yarn.

In the fabric and the composite yarn of the present invention, it is preferable that the composite yarn further include a sizing agent formed on the surface of the spun yarn. In that case, the water-soluble polymer fiber and the sizing agent will be dissolved and removed from the spun yarn fabric.

Moreover, it is preferable that the water-soluble polymer fiber according to the present invention includes a first water-soluble polymer fiber wound around the surface of the spun yarn by twisting in a first direction with gaps provided between the fibers, and a second water-soluble polymer fiber wound around the surface of the spun yarn by twisting in a second direction which is opposite to the first direction with gaps provided between the fibers.

In addition, it is more preferable that the water-soluble polymer fiber be a water-soluble vinylon fiber.

Moreover, in the isotropic pitch-based carbon fiber spun yarn used for the fabric and the composite yarn of the present invention, it is preferable:

(i) that a maximum diameter of fine carbon fiber aggregates contained in the spun yarn be equal to or below 3.0 times an average diameter of foundation yarn of the spun yarn and a maximum length thereof be equal to or below 10 mm; and (ii) that an abundance ratio of the fine carbon fiber aggregates, which are contained in the spun yarn, be equal to or below 3 pieces per 10 m, the fine carbon fiber aggregates having the maximum diameter in a range of 1.5 to 3.0 times the average diameter of the foundation yarn of the spun yarn, and having the maximum length in a range of 3 to 10 mm.

A method of manufacturing an isotropic pitch-based carbon fiber spun yarn fabric of the present invention is a method including the following steps: namely, a step of obtaining composite yarn by winding a water-soluble polymer fiber around a surface of isotropic pitch-based carbon fiber spun yarn; a step of obtaining a composite yarn fabric by weaving the composite yarn; and a step of obtaining the isotropic pitch-based carbon fiber spun yarn fabric by dissolving and removing the water-soluble polymer fiber from the composite yarn fabric.

In the method of manufacturing the fabric of the present invention, it is preferable that the method further includes a step of forming a sizing agent layer by applying a sizing agent aqueous solution onto the surface of the spun yarn and then drying it. In that case, the water-soluble polymer fiber and the sizing agent will be dissolved and removed from the composite yarn fabric in the step of obtaining the isotropic pitch-based carbon fiber spun yarn fabric.

Moreover, it is preferable that the step of obtaining the composite yarn in the method of the present invention includes a step of winding a first water-soluble polymer fiber around the surface of the spun yarn by twisting in a first direction with gaps provided between the fibers, and a step of winding a second water-soluble polymer fiber around the surface of the spun yarn by twisting in a second direction opposite to the first direction with gaps provided between the fibers.

In addition, it is more preferable that the water-soluble polymer fiber according to the present invention is a water-soluble vinylon fiber.

Meanwhile, it is preferable that the method of manufacturing the fabric of the present invention further includes a removing step of removing the fine carbon fibers and the aggregates thereof from the isotropic pitch-based carbon fiber spun yarn, whereby:

(i) it is preferable to obtain the isotropic pitch-based carbon fiber spun yarn in which the maximum diameter of the fine carbon fiber aggregates contained in the spun yarn is equal to or below 3.0 times an average diameter of the foundation yarn of the spun yarn, and the maximum length thereof is equal to or below 10 mm; and (ii) it is preferable to obtain the isotropic pitch-based carbon fiber spun yarn in which an abundance ratio of the fine carbon fiber aggregates contained in the spun yarn is equal to or below 3 pieces per 10 m, the fine carbon fiber aggregates having the maximum diameter in a range of 1.5 to 3.0 times the average diameter of the foundation yarn of the spun yarn and the maximum length in a range of 3 to 10 mm.

Moreover, in the method of manufacturing the fabric of the present invention, it is preferable that the removing step be at least one method selected from the group consisting of the following (a) to (d):

(a) a method of allowing the spun yarn to contact a roller rotating in the same direction as a traveling direction of the spun yarn at a circumferential velocity equal to or greater than a feeding velocity of the spun yarn;

(b) a method of blowing an air flow over the spun yarn;

(c) a method of washing the spun yarn with water; and (d) a method of washing the spun yarn with water while applying an ultrasonic wave.

Concerning the isotropic pitch-based carbon fiber spun yarn of the present invention, it is preferable that fine carbon fiber aggregates contained in the spun yarn has the maximum diameter equal to or below 3.0 times the average diameter of the foundation yarn of the spun yarn and the maximum length equal to or below 10 mm.

For the spun yarn of the present invention, it is preferable that an abundance ratio of the fine carbon fiber aggregates contained in the spun yarn be equal to or below 3 pieces per 10 m, the fine carbon fiber aggregates having the maximum diameter in a range of 1.5 to 3.0 times the average diameter of the foundation yarn and the maximum length in a range of 3 to 10 mm.

A method of manufacturing the isotropic pitch-based carbon fiber spun yarn of the present invention is a method of removing fine carbon fibers and aggregates thereof by at least one method of removing selected from the group consisting of the following (a) to (d):

(a) a method of allowing the spun yarn to contact a roller rotating in the same direction as a traveling direction of the spun yarn at a circumferential velocity equal to or faster than a feeding velocity of the spun yarn;

(b) a method of blowing an air flow over the spun yarn;

(c) a method of washing the spun yarn with water; and (d) a method of washing the spun yarn with water while applying an ultrasonic wave, and thereby obtaining the spun yarn containing the fine carbon fiber aggregates having a maximum diameter equal to or below 3.0 times an average diameter of foundation yarn of the spun yarn and a maximum length equal to or below 10 mm.

In the method of manufacturing the spun yarn of the present invention, it is more preferable that the isotropic pitch-based carbon fiber spun yarn to be obtained has an abundance ratio of the fine carbon fiber aggregates, which are contained in the spun yarn, be equal to or below 3 pieces per 10 m, the fine carbon fiber aggregates having the maximum diameter in a range of 1.5 to 3.0 times as large as the average diameter of the foundation yarn and the maximum length in a range of 3 to 10 mm.

DETAILED DESCRIPTION OF THE PREFERRED EMBODIMENTS

Figure 1:
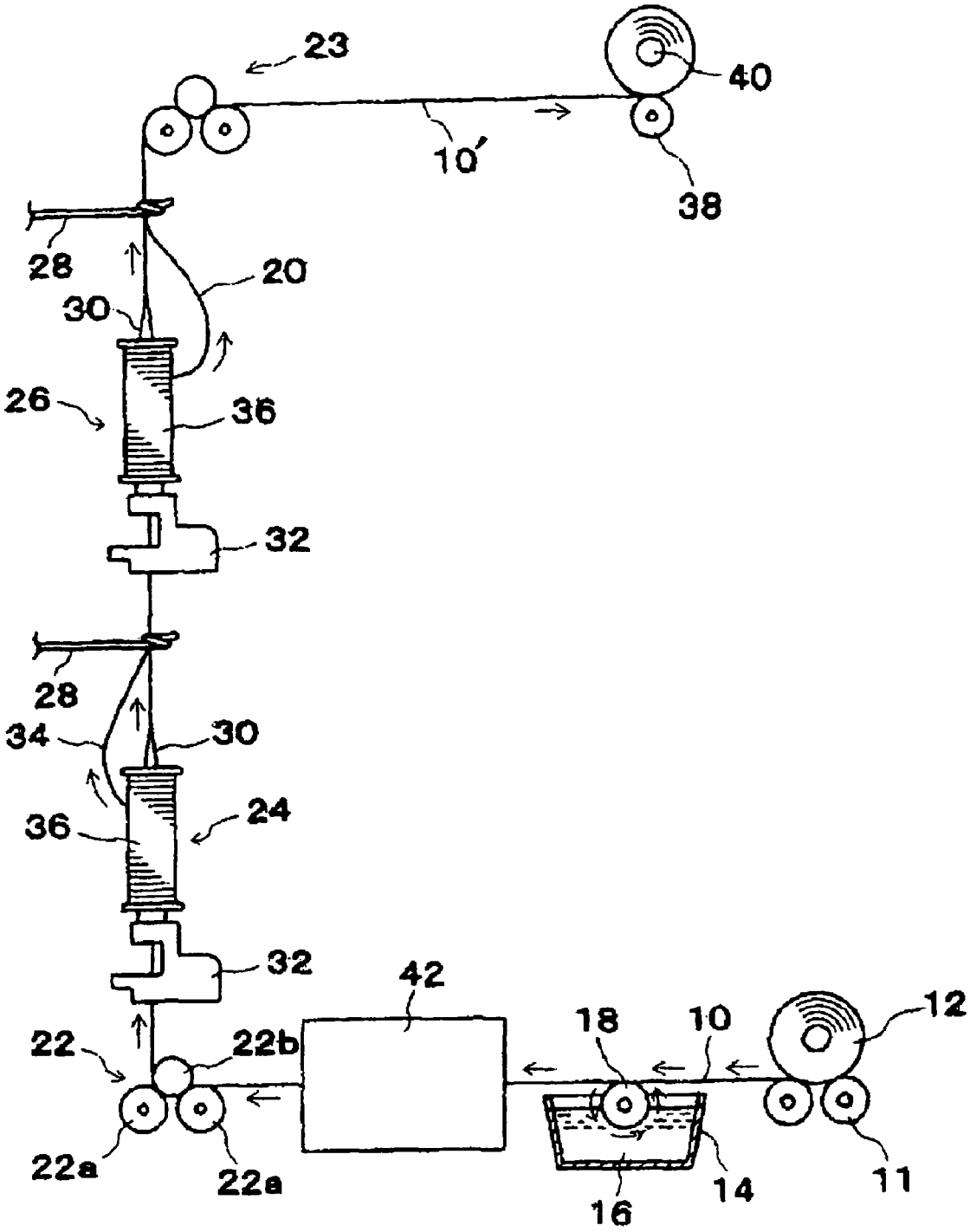
FIG. 1 is a schematic side view of an apparatus used for manufacturing composite yarn for a fabric of the present invention.

Now, the present invention will be described in detail in line with the preferred embodiments.

First, isotropic pitch-based carbon fiber spun yarn of the present invention will be described. Specifically, in the isotropic pitch-based carbon fiber spun yarn of the present invention, fine carbon fiber aggregates contained in the spun yarn has a maximum diameter equal to or below 3.0 times (or more preferably equal to or below 2.0 times) an average diameter of foundation yarn of the spun yarn and a maximum length equal to or below 10 mm (more preferably equal to or below 7 mm, or particularly preferably equal to or below 5 mm).

A frequency of thread breakage is reduced and an amount of dust is also reduced as the size and the quantity of the fine carbon fiber aggregates contained in the isotropic pitch-based carbon fiber spun yarn of the present invention are reduced. When using isotropic pitch-based carbon fiber spun yarn containing fine carbon fiber aggregates, which have the maximum diameter exceeding 3.0 times of the average diameter of foundation yarn, or which have the maximum length exceeding 10 mm, the amount of dust is increased and a work environment is thereby deteriorated at the time of weaving, and moreover, the thread breakage occurs more frequently. In the meantime, a large amount of fine carbon fiber aggregates in a fabric will spoil appearance of the fabric and will cause thickness irregularity and fiber areal weight irregularity of the fabric.

As the spun yarn of the present invention, it is preferable that an abundance ratio of, which are contained in the spun yarn, be equal to or below 3 pieces per 10 m, the fine carbon fiber aggregates having the maximum diameter in a range of 1.5 to 3.0 times the average diameter of the foundation yarn and the maximum length in a range of 3 to 10 mm.

When the abundance ratio of such fine carbon fiber aggregates exceeds 3 pieces per 10 m, the amount of dust is increased and the work environment is thereby deteriorated at the time of weaving, and moreover, the thread breakage tends to occur easily.

Note that the fine carbon fiber aggregate like this is generally called a nep, which primarily means fine carbon fiber lint, fluff and the like entangled together and inserted to the foundation yarn, and those attached to a surface of the foundation yarn. The fine carbon fiber aggregate includes one which is clearly recognized in a grain shape after forming a fabric, and a node formed of a fiber which is not placed parallel to the foundation yarn but is entangled therewith.

Moreover, as described previously, there are tendencies of frequently occurring shutdowns of a loom in the course of weaving and occurring thread breakage if the size of the above-described fine carbon fiber aggregates exceeds a specific size or if the number thereof exceeds a specific amount. The inventors of the present invention speculate the reasons as follows.

Specifically, first of all, one of the reasons is attributed to a fact that generation of dust is caused by part of the fine carbon fiber aggregate which protrudes like fluff out of a gap of the water-soluble polymer fiber wound thereon, then contacts a guide, a roller or the like of a loom and gets broken and flies apart at the time of weaving with a high-speed loom. Next, one reason for frequent occurrence of shutdown of a loom in the course of high-speed weaving is attributed to thread breakage of the carbon fiber composite yarn, and the cause thereof is considered to be the thread breakage due to an impact at the time when a portion of the fine carbon fiber aggregate in a node shape hits the guide, the roller or the like of the loom. Another reason is considered to be emergency shutdown attributable to a short circuit caused by the floating dust of the fine carbon fiber contacting an electric circuit exposed on the loom.

Meanwhile, the values of the size and the number of the fine carbon fiber aggregates used in the present invention are equivalent to the values measured by the following method. Specifically, dimensions of the fine carbon fiber aggregates in a direction perpendicular to a fibrous direction of the spun yarn are measured with a slide caliper and the largest value is defined as a maximum diameter. Meanwhile, dimensions (lengths) of the fine carbon fiber aggregates in the direction parallel to the fibrous direction of the spun yarn are measured with the slide caliper and the largest value is defined as a maximum length. Then, in terms of the spun yarn having a length of 10 m which is twisted, and which is in a dry state, the number of the fine carbon fiber aggregates having either the maximum diameter exceeding 3.0 times of the average diameter of the foundation yarn or the maximum length exceeding 10 mm is counted.

The thickness (fineness) of the foundation yarn in the isotropic pitch-based carbon fiber spun yarn of the present invention is not particularly limited. However, as described in detail below, since the water-soluble polymer fiber is wound around the spun yarn, it is not possible to perform weaving by use of a high-speed rapier loom or the like without using the isotropic pitch-based carbon fiber spun yarn having a weight per 1000 m equal to or below 890 (tex) (8000 deniers), it is preferable that the thickness of the foundation yarn be approximately in a range from 30 (270 deniers) to 890 tex (8000 deniers).

Next, a method of manufacturing isotropic pitch-based carbon fiber spun yarn of the present invention will be described. Specifically, the method of manufacturing the isotropic pitch-based carbon fiber spun yarn of the present invention is a method of obtaining the above-described isotropic pitch-based carbon fiber spun yarn of the present invention by removing fine carbon fibers and aggregates thereof (a removing step) in accordance with at least one method selected from the group consisting of the following (a) to (d):

(a) a method of allowing the spun yarn to contact a roller rotating in the same direction as a traveling direction of the spun yarn at a circumferential velocity equal to or faster than a feeding velocity of the spun yarn;

(b) a method of blowing an air flow over the spun yarn;

(c) a method of washing the spun yarn with water; and (d) a method of washing the spun yarn with water while applying an ultrasonic wave.

In the present invention, the method of manufacturing the isotropic pitch-based carbon fiber spun yarn to be provided for such a removing step is not particularly limited. However, a method including the steps of firstly forming isotropic pitch-based carbon fibers of a mat shape in accordance with the method described in Japanese Unexamined Patent Application Publication No. Sho 62-33823, for example and subsequently performing a carding process, a drawing process, and a fine spinning process to be described below is favorably employed.

Specifically, first of all, a spinning method for pitch-based short fibers include a centrifugal method (a rotation spinning method) configured to pour melted pitch out of a nozzle by use of centrifugal force, a melt-blow method configured to blow melted pitch together with high-temperature high-speed air, a vortex method configured to form the high-temperature high-speed air in the melt-blow method into a vortex shape and to perform drafting by use of such a swirling flow, an air sucker method configured to suck a fiber into an air sucker nozzle and draft the fiber, and then collect the fiber after an exit thereof, and the like. Here, it is also possible to apply both of bundle-shaped pitch fibers and mat-shaped pitch fibers which are obtained by any of the foregoing methods.

Moreover, in the method described in Japanese Unexamined Patent Application Publication No. Sho 62-33823, a melt spinning method with a centrifugal spinning machine having a horizontal rotating shaft is employed from the view point of production efficiency, and the mat-shaped pitch fibers deposited on a conveyor belt (which preferably possesses air permeability so as to enable suction from the opposite side to a depositional surface of the pitch-based fiber) are then subjected to infusibilization and a heat treatment in the usual way and are formed into carbon fibers.

Such infusibilization is performed by heating to a range from 100° C. to 400° C. in an air atmosphere containing oxidative gas such as $NO_2$, $SO_2$ or ozone. Meanwhile, the heat treatment is performed by heating to a range from 700° C. to 3000° C. or preferably in a range from 900° C. to 2500° C. in a non-oxidative atmosphere. This heat treatment may be performed either in the state before formation of the spun yarn or in the state after formation of the spun yarn.

Normally, the heat treatment in a range from 700° C. to 1000° C. is performed in the mat state, and the heat treatment at a higher temperature is performed in the state of a sliver which is obtained by performing the carding process on the mat-shaped isotropic pitch-based carbon fibers, which have been subjected to the heat treatment in the range from 700° C. to 1000° C. once.

Concerning the dimensions (after adjustment of the thickness and the width as appropriate) of the isotropic pitch-based carbon fiber mat thus formed by performing the heat treatment in the range from 700° C. to 1000° C., the isotropic pitch-based carbon fiber may have a single fiber diameter in a range from 5 to 20 μm, fiber areal weight in a range from 0.1 to 0.6 kg/m2, the thickness in a range from 5 to 30 mm, the width in a range from 100 to 850 mm, and the length equal to or above 100 m, for example. If necessary, it is possible to preserve the mat by winding up in a roll shape so as to prepare for the subsequent carding process, or to preserve the mat by folding.

The isotropic pitch-based carbon fiber mat thus formed on the convey or belt is subjected to fine adjustment for respectively the thickness and the width thereof by passing it through between a pair of rollers when appropriate, and is then subjected to the carding process.

For the carding machine, a carding machine (broad gills) modified to be broader for handling the mat-shaped isotropic pitch-based carbon fiber processing is preferably employed. A basic configuration thereof includes an oil spray device and a faller provided with a pair of numerical metal planted needle rows respectively above and below the mat, which are disposed between a back roller and a front roller that are located in the traveling direction of the isotropic pitch-based carbon fiber mat. Onto the isotropic pitch-based carbon fiber mat supplied from the conveyor belt, an oil solution for facilitating the carding process is sprayed and applied at a proportion of approximately 1.8% to 2.0% by mass in the course of transfer from the back roller to the front roller, and the mat is further subjected to the carding process (carding) by timely insertion of the pair of numerous planted needle rows of the faller into the mat to align in the fibrous direction thereof. Simultaneously, the isotropic pitch-based carbon fibers are drafted by way of a circumferential velocity ratio between the back roller and the front roller which is rotated at a higher circumferential velocity than the back roller.

The isotropic pitch-based carbon fibers, which have come out of the front roller after performing the drafting and carding processes thereon by the carding machine, are formed into the sliver having an improved orientation of the fibrous direction, and are slit as appropriate and then wound cylindrically around a coiler.

The obtained isotropic pitch-based carbon fiber sliver is subjected to a process for obtaining a sliver with improved fibrous orientation and homogeneity by the drawing process (doubling and drafting a plurality of slivers) with a drawing machine.

For example, two slivers in the roughly wound state taken out of the coiler are doubled by the drawing machine in the process of transmission along a krill guide and a sliver guide. After being subjected to drafting between the back roller and the front roller and twisting again with the faller, the sliver having the improved orientation is sent to a product case.

Normally, in order to form spun yarn in a fine spinning step, the above-descried drawing process is performed multiple times to obtain the isotropic pitch-based carbon fiber sliver having the suitable thickness and fibrous orientation.

Subsequently, the isotropic pitch-based carbon fiber sliver having the thickness and the fibrous orientation suitable for fine spinning is subjected to drafting and twisting (primary twisting) by use of a fine spinning machine (a ring spinning machine), whereby single twisted yarn (single yarn) is obtained and would around a bobbin.

The obtained single twisted yarn (the single yarn) is subjected to doubling of a plurality of threads of the single twisted yarn and to twisting (secondary twisting) by use of a twisting machine as appropriate, whereby organzine (two ply yarn) is obtained. In the present invention, either the single twisted yarn (the single yarn) or the organzine (the two ply yarn) of the isotropic pitch-based carbon fiber spun yarn is applicable.

When the isotropic carbon fiber spun yarn is manufactured in accordance with the foregoing conventional method, generation of somewhat large fine carbon fiber aggregates is inevitable. Hence any types of spun yarn are apt to contain fine carbon fiber aggregates having the maximum diameter exceeding 3.0 times of the average diameter of the foundation yarn of the spun yarn and the maximum length exceeding 10 mm.

Subsequently, in the method of manufacturing the isotropic pitch-based carbon fiber spun yarn of the present invention, the fine carbon fibers and the aggregates thereof are removed from the above-described isotropic pitch-based carbon fiber spun yarn in accordance with at least one method selected from the aforementioned group consisting of (a) to (d).

The aforementioned method (a) may include a method of allowing the spun yarn to contact a surface of an upper part of a touch roller 18, which is partially immersed in a sizing agent aqueous solution 16, and which is rotated in the same direction as a traveling direction of spun yarn 10 at a circumferential velocity equal or faster than a velocity at which the spun yarn 10 is pulled out, as shown in FIG. 1 to be described later in detail, for example.

Upon impregnation of the sizing agent aqueous solution, if the isotropic pitch-based carbon fiber spun yarn 10 is dipped in and impregnated with (dipped) the sizing agent aqueous solution, the fine carbon fibers either attached to or contained in either fluff of the spun yarn 10 or a surface thereof are accumulated at a contact region with a guide or a roller due to friction with the guide or the roller when squeezing out the excessive sizing agent aqueous solution and gradually form agglomerates. When the agglomerates are carried to a subsequent process while being buried on the surface of the spun yarn 10, those portions are apt to constitute the fine carbon fiber aggregates, or the fine carbon fibers attached to the fluff of the spun yarn 10 or the surface of the spun yarn are apt to fall off and constitute agglomerates in the solution and then to be attached to the surface of the spun yarn 10 again, thereby constituting the fine carbon fiber aggregates of the spun yarn 10. For this reason, it is preferable to allow the isotropic pitch-based carbon fiber spun yarn 10 to contact the sizing agent aqueous solution formed into a coating on a surface of the roller 18, the surface being located above the fluid level of the sizing agent aqueous solution, so as to impregnate the spun yarn with the sizing agent aqueous solution.

Meanwhile, when the circumferential velocity of the touch roller 18 is set at a slower velocity than the velocity at which the isotropic pitch-based carbon fiber spun yarn 10 is pulled out, the fine carbon fibers either attached to or contained in the fluff of the spun yarn 10 or the surface of the spun yarn are accumulated in a space between the spun yarn 10 and the touch roller 18 and gradually form agglomerates. When the agglomerates are carried to a subsequent process while being buried on the surface of the spun yarn 10, those portions are apt to constitute the fine carbon fiber aggregates. For this reason, in order to remove the fine carbon fibers either attached to or contained in the surface of the spun yarn 10, it is essential to set the circumferential velocity of the touch roller 18 at a velocity equal to or greater than the velocity at which the spun yarn 10 is pulled out. The circumferential velocity of such the touch roller 18 is preferably set approximately in a range from 1 to 200 m/sec, while a feeding velocity of the spun yarn 10 is set preferably approximately in a range from 1 to 100 m/sec.

Figure 4:
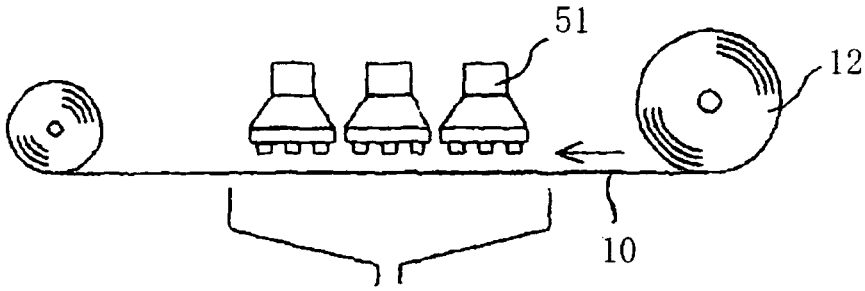
FIG. 4 is a schematic side view showing a method of removing fine carbon fibers and aggregates thereof with an air flow.

The method (b) described above may include a method of blowing compressed air from a nozzle (air flush) 51 to the spun yarn 10 as shown in FIG. 4, for example. A linear velocity of such air is set preferably approximately in a range from 10 to 40 m/sec, while the feeding velocity of the spun yarn 10 is set preferably approximately in a range from 1 to 50 m/sec.

Figure 5:
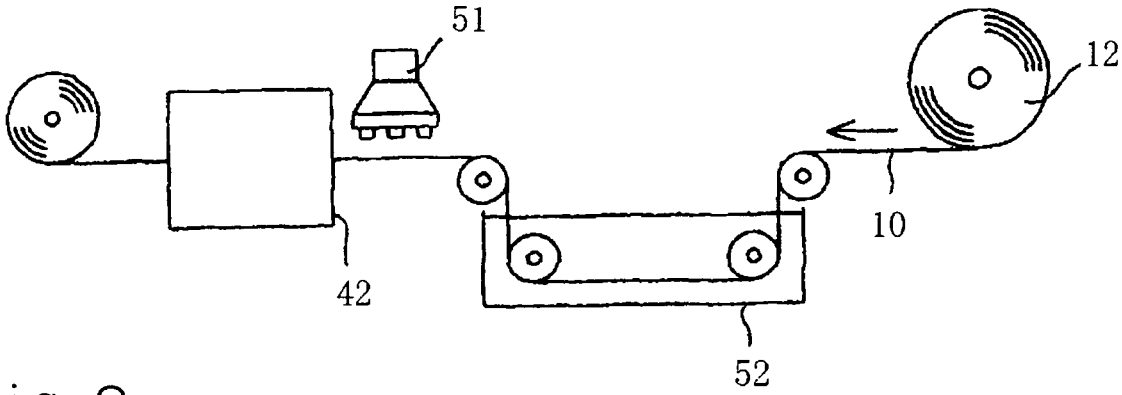
FIG. 5 is a schematic side view showing a method of removing fine carbon fibers and aggregates thereof by water washing and by an air flow.

The method (c) described above may include a method of putting the spun yarn 10 into a water tank 52, then blowing compressed air thereon from the nozzle 51 as appropriate, and then drying with a drier 42 as shown in FIG. 5, for example. Retention time of the spun yarn 10 inside the water tank in this method is set preferably approximately in a range from 5 to 30 sec, while the feeding velocity of the spun yarn 10 is set preferably approximately in a range from 1 to 50 m/sec.

Figure 6:
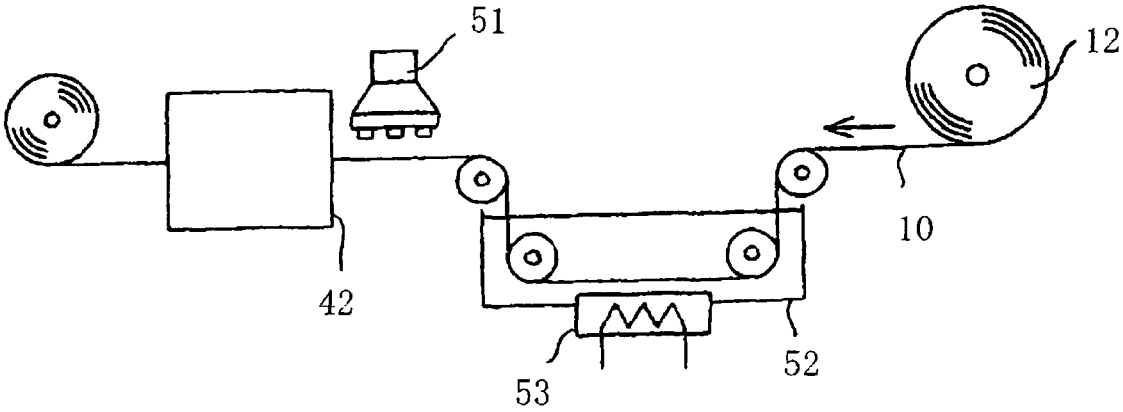
FIG. 6 is a schematic side view showing a method of removing fine carbon fibers and aggregates thereof by water washing while applying an ultrasonic wave and by an air flow.

The method (d) described above may include a method of applying an ultrasonic wave from an ultrasonic generator 53 on the spun yarn 10 while putting the spun yarn 10 into a water tank 52, then blowing compressed air thereon from the nozzle 51 as appropriate, and then drying the spun yarn 10 with the drier 42 as shown in FIG. 6, for example. Note that, a frequency of the ultrasonic wave in this method is set preferably approximately in a range from 28 to 170 kHz. Moreover, the retention time of the spun yarn 10 inside the water tank in this method is set preferably approximately in a range from 5 to 30 sec, and the feeding velocity of the spun yarn 10 is set preferably approximately in a range from 1 to 50 m/sec.

In the present invention, the above-described isotropic pitch-based carbon fiber spun yarn having the limited size of the fine carbon fiber aggregates can not be obtained without removing the fine carbon fibers and the aggregates thereof in accordance with the above-described removing step. Moreover, the isotropic pitch-based carbon fiber spun yarn of the present invention thus obtained cannot be directly subjected to high-speed weaving, and it is necessary to form the spun yarn into the composite yarn to be described below in detail by means of winding a water-soluble polymer fiber around the surface of the isotropic pitch-based carbon fiber spun yarn.

Now, composite yarn of the present invention will be described. Specifically, the composite yarn of the present invention includes isotropic pitch-based carbon fiber spun yarn and a water-soluble polymer fiber which is wound around a surface of the spun yarn. In this way, by combining both of the constituents while winding the water-soluble polymer fiber around the surface of the spun yarn, a binding force between the fibers is improved while retaining flexibility of the fibers, and moreover, strength of the composite yarn is improved while fluffing is suppressed. Accordingly, in the case of using the composite yarn of the present invention, it is possible to perform weaving without causing thread breakage at the time of high-speed weaving or incurring emergency shutdown of a high-speed loom. In addition, it is possible to prevent generation of dust sufficiently at the time of weaving.

Moreover, it is preferable to use the above-described isotropic pitch-based carbon fiber spun yarn of the present invention as spun yarn. A fabric obtained by use of this composite yarn has a small size and a small number of the fine carbon fiber aggregates. Accordingly, the fabric has excellent appearance and little fiber areal weight irregularity and thickness irregularity.

In the present invention, by using the isotropic pitch-based carbon fiber spun yarn as described above, it is possible to wind the water-soluble polymer fiber easily and uniformly thereon. Moreover, it is possible to prevent deviation by friction with the guide or the roller in the spinning and weaving process. The inventors of the present invention speculate that this is attributed to a synergistic effect of properties of the surface of the isotropic pitch-based carbon fiber and moderate fluff on the surface of the spun yarn.

The water-soluble polymer fiber according to the present invention only needs to be capable of improving strength of the spun yarn at the time of weaving and also capable of being dissolved and removed after weaving. Although there is no particular limitation, a water-soluble vinylon fiber is preferable in particular.

Although the thickness (fineness) of the water-soluble polymer fiber according to the present invention is not particularly limited, it is preferably set approximately in a range from 30 to 300 dtex. Moreover, the water-soluble polymer fiber according to the present invention may be any of multifilament, monofilament, and spun yarn.

The number of the windings of the water-soluble polymer fiber per meter of the spun yarn is set normally in a range from 80 to 3000 rounds, or preferably in a range from 200 to 2500 rounds, or more preferably from 500 to 1800 rounds.

Furthermore, in the present invention, it is preferable that the water-soluble polymer fiber include a first water-soluble polymer fiber wound around the surface of the spun yarn by twisting in a first direction with gaps provided between the fibers, and a second water-soluble polymer fiber wound around the surface of the spun yarn by twisting in a second direction which is opposite to the first direction with gaps provided between the fibers. The composite yarn obtained by use of these water-soluble polymer fibers has a small number of small nodes which are formed of the fine carbon fiber aggregates, and tensile strength thereof is further improved while deformation of the thread shape thereof by the first water-soluble polymer fiber is eliminated. Hence the composite yarn retains flexibility thereof and remains in a substantially straight shape when being pulled out of the bobbin. Accordingly, it is possible to obtain the composite yarn which is provided with sufficiently high tensile strength thereof and is easier to handle without requiring corrections in particular. At the same time, there is a tendency that generation of dust out of the isotropic pitch-based carbon fibers is apt to be prevented more reliably as the contacts of the composite yarn with guides, rollers, and the like of a loom are considerably reduced.

The both numbers of the windings of the first and the windings of the second water-soluble polymer fibers per meter of the spun yarn are set normally in a range from 80 to 3000 rounds, or preferably in a range from 200 to 2500 rounds, or more preferably from 500 to 1800 rounds in each case.

Note that, if the water-soluble polymer fiber is wound tightly without providing the clearance so that the isotropic pitch-based carbon fiber spun yarn is invisible, the obtained composite yarn becomes hard and a weaving performance is apt to be deteriorated. For this reason, when winding the water-soluble polymer fibers, it is preferable to secure the clearance so as to retain the flexibility of the obtained composite yarn and not to hinder the weaving performance thereafter.

Meanwhile, in the present invention, it is preferable to further provide a sizing agent layer formed on the surface of the spun yarn. When winding the water-soluble polymer fiber around the surface of the spun yarn while interposing such a sizing agent layer between the water-soluble polymer fibers and the surface of the spun yarn, fluffing of the spun yarn is suppressed more as compared to the case of not interposing the sizing agent layer, and it is possible to suppress generation of dust of the isotropic pitch-based carbon fibers more reliably in the spinning and weaving process. Moreover, generation of static electricity is prevented and smoothness and flexibility of the fabric to be obtained tend to be more improved.

As a composition of a sizing agent aqueous solution for obtaining such a sizing agent layer, a polyvinyl alcohol aqueous solution, a methylcellulose aqueous solution, an ethylcellulose aqueous solution, a methylethylcellulose aqueous solution, a polyacrylamide aqueous solution, a starch aqueous solution, and the like, can be given. From the viewpoint of excellence in suppression of fluffing of the spun yarn, one containing polyvinyl alcohol of 70% to 90% by mass, acrylic resin of 1% to 10% by mass, a penetrant of 1% to 5% by mass, a wax-type oil solution of 1% to 10% by mass, and water of 1% to 5% by mass is preferred.

Moreover, although an amount of the sizing agent applied to the spun yarn is not particularly limited, it is preferable to set the amount approximately in a range from 0.1 to 10 parts by mass (solid equivalent).

Next, a method of manufacturing the composite yarn of the present invention will be described. Specifically, in the present invention, the composite yarn is obtained by winding the water-soluble polymer fiber around the surface of the isotropic pitch-based carbon fiber spun yarn. Although a concrete method of winding the water-soluble polymer fiber around the surface of the isotropic pitch-based carbon fiber spun yarn as mentioned above is not particularly limited, it is embodied preferably by use of an apparatus shown in FIG. 1, for example.

FIG. 1 shows one preferred example of an apparatus used for manufacturing the composite yarn of the present invention. First, the isotropic pitch-based carbon fiber spun yarn 10 wound around a cheese 12 is placed on a pair of rewinding rollers 11 and is thereby rewound. A sizing agent tank 14 is filled with a sizing agent aqueous solution 16, and the spun yarn 10 pulled out of the cheese 12 is then pulled out after coming in contact with an upper surface of a rotating touch roller 18, which is partially immersed in the sizing agent aqueous solution 16. Accordingly, the sizing agent aqueous solution is impregnated into the surface of the spun yarn 10 (a touch roller method).

Figure 2:
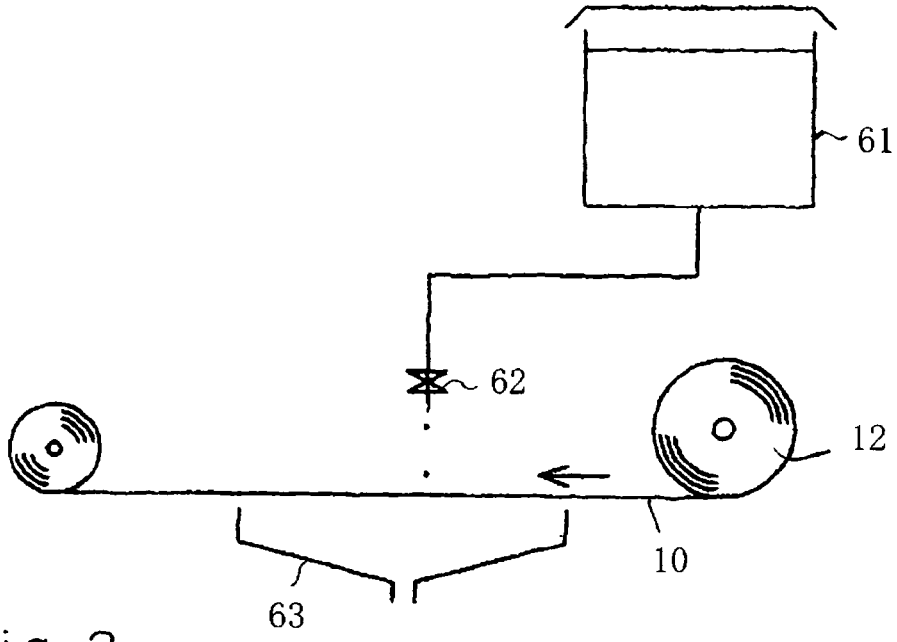
FIG. 2 is a schematic side view showing a method of dripping a sizing agent.
Figure 3:
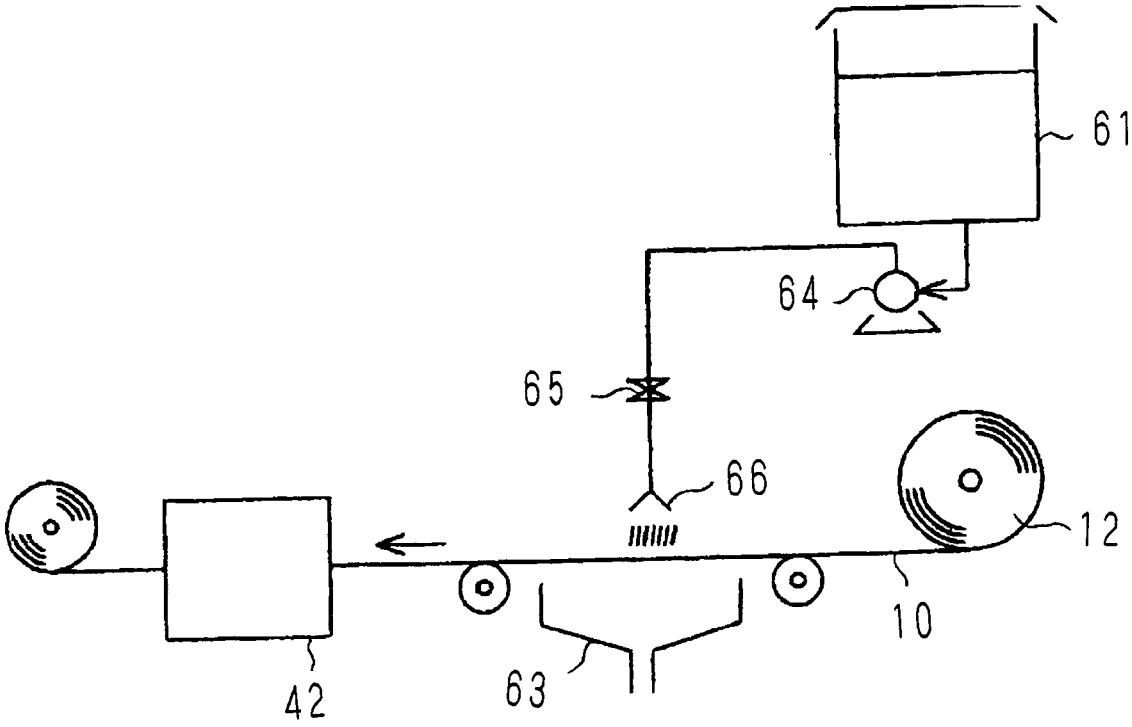
FIG. 3 is a schematic side view showing a method of coating (mist spraying) the sizing agent.

Note that, in addition to the touch roller method as shown in FIG. 1, it is possible to use a dripping method as shown in FIG. 2, an atomization method (a spray method) as shown in FIG. 3, and a method combining two or more of these methods as the method of impregnating the sizing agent aqueous solution into the spun yarn. However, the touch roller method is particularly preferred in light of capability of impregnating the sizing agent aqueous solution more uniformly and easily. Here, in FIG. 2, reference numeral 61 denotes a sizing agent tank, reference numeral 62 denotes a dripping amount control valve, and reference numeral 63 denotes a sizing agent aqueous solution collector. Meanwhile, in FIG. 3, reference numeral 61 denotes a sizing agent tank, reference numeral 63 denotes a sizing agent aqueous solution collector, reference numeral 64 denotes a pump, reference numeral 65 denotes a spray amount control valve, and reference numeral 66 denotes a spray nozzle. Moreover, it is preferable to perform impregnation of the sizing agent aqueous solution by use of the atomization method (the spray method) and the dripping method after removing the fine carbon fibers and the aggregates thereof from the isotropic pitch-based carbon fiber spun yarn 10 by use of the above-described methods in advance and then drying the spun yarn.

Subsequently, in the apparatus shown in FIG. 1, the carbon fiber spun yarn 10 impregnated with the sizing agent aqueous solution is drawn into the drier 42, and moisture in the sizing agent aqueous solution impregnated into the spun yarn 10 is removed in the course of passage through this drier 42.

Meanwhile, a tension roller 22 is constitute of a pair of drive rollers 22a and 22a which are horizontally arranged with a predetermined interval, and a weight roller 22b which is placed thereon.

A first winding device 24 and a second winding device 26 are disposed in series above the tension roller 22, and the isotropic pitch-based carbon fiber spun yarn 10 pulled out of the tension roller 22 penetrates the winding devices. Each of the first winding device 24 and the second winding device 26 is constituted of a snail wire 28, a spindle 30, and a spindle drive motor 32. The snail wire 28 has a tip end formed into a spiral shape, and the spun yarn 10 penetrates a center of a circular space thus defined.

Meanwhile, a bobbin 36 on which a water-soluble polymer fiber 34 is rolled is fitted to the spindle 30. As the spindle 30 rotates at desired revolutions, the water-soluble polymer fiber 34 pulled out of the bobbin 36 is rotated inside a circumference of the circular space of the snail wire 28, and is wound around the spun yarn 10 which passes through the center of the circular space. Since the first winding device 24 and the second winding device 26 have the same configuration, operations thereof are identical to each other except that the winding directions are different.

When simultaneously using both of the winding devices, the first water-soluble polymer fiber 34 is wound either in a right-handed direction or in a left-handed direction by use of the first winding device 24, while a second water-soluble polymer fiber 20 is wound in the opposite direction to that of the first water-soluble polymer fiber 34 by use of the second winding device 26. In addition, another water-soluble polymer fiber may be wound thereon if necessary. The numbers of the windings of the first water-soluble polymer fiber 34 and the second water-soluble polymer fiber 20 are preferably set equal to each other from the perspective of elimination of deflection attributable to the winding directions.

Subsequently, composite yarn 10' formed by winding the water-soluble polymer fiber around the surface of the isotropic pitch-based carbon fiber spun yarn passes through an upper tension roller 23, and is wound around a wooden bobbin 40 which is rotated in contact with a winding roller 38.

Next, an isotropic pitch-based carbon fiber spun yarn fabric of the present invention and a manufacturing method thereof will be described. Specifically, the isotropic pitch-based carbon fiber spun yarn fabric of the present invention is formed by dissolving and removing the water-soluble polymer fiber from the composite yarn fabric, which is fabricated by weaving the composite yarn of the present invention.

Moreover, the method of manufacturing the isotropic pitch-based carbon fiber spun yarn fabric of the present invention is a method including the above-described step of obtaining the composite yarn, and moreover, the steps of obtaining the composite yarn fabric by weaving the composite yarn, and obtaining the isotropic pitch-based carbon fiber spun yarn fabric by dissolving and removing the water-soluble polymer fiber from the composite yarn fabric.

In the method of manufacturing the fabric of the present invention, it is preferable to further include the step of forming the sizing agent layer by applying and subsequently drying the sizing agent aqueous solution on the surface of the spun yarn as shown in FIG. 1 to FIG. 3. In that case, the water-soluble polymer fiber and the sizing agent will be dissolved and removed from the composite yarn fabric to be obtained.

In the present invention, a concrete method of weaving the composite yarn is not particularly limited. For example, there can be cited a method of weaving the composite yarn at a high speed by use of a rapier loom or a Sulzer loom.

Moreover, in the present invention, a concrete method of dissolving and removing the water-soluble polymer fiber (alternatively, the water-soluble polymer fiber and the sizing agent) from the composite yarn fabric is not particularly limited. For example, there can be cited a method of dissolving and removing a component to be removed by using any of an enzyme-based desizing agent, water at a temperature in a range of 20° C. to 100° C., and a combination thereof.

In this way, it is possible to obtain the isotropic pitch-based carbon fiber spun yarn fabric of the present invention, which is substantially made of the isotropic pitch-based carbon fibers, which has little fine carbon fiber aggregates, which is excellent in appearance, and which has little thickness irregularity and fiber areal weight irregularity. A weaving pattern of the isotropic pitch-based carbon fiber spun yarn fabric of the present invention is not particularly limited, and it is possible to perform plain weave, twill weave, satin weave, basket weave, and so forth. Here, the expression "substantially made of the isotropic pitch-based carbon fibers" means that the fabric contains at least 98% by mass of the isotropic pitch-based carbon fibers. Such a fabric constitutes the isotropic pitch-based carbon fiber spun yarn fabric.

EXAMPLES

Now, the present invention will be described more in detail based on examples and comparative examples. However, the present invention will not be limited to the following examples. Note that, throughout the following examples and comparative examples, various physical property values described in this description represent values obtained by the following procedures.

<Tensile Strength and Elongation Percentage of Isotropic Pitch-Based Carbon Fiber Spun Yarn and Composite Yarn>

A clamping interval was set at 300 mm. Then, maximum tensile strength (N) and elongation percentage (%) of the sample when pulling the sample at a tensile rate of 200 mm/min were measured by use of a tension tester ("Tensilon Universal Tester Model 1310, made by Orientec Co., Ltd.). Here, an average value of the measured values of five samples was obtained.

<Tensile Strength of Isotropic Pitch-Based Carbon Fiber Spun Yarn Fabric>

Five test pieces having a width of about 55 mm and a length of about 250 mm were collected in each of the warp direction and the weft direction. Subsequently, a clamping interval was set equal to 150 mm and the width was reduced to 50 mm by removing threads from both sides in the width direction, and then maximum tensile strength (N) was measured while being pulled at a tensile rate of 200 mm/min by use of the tension tester ("Tensilon Universal Tester Model 1310, made by Orientec Co., Ltd.). An average value of the measured values of the five pieces in each of the warp direction and the weft direction was obtained.

Reference Example 1

Manufacturing isotropic pitch-based carbon fiber spun yarn of 1500 deniers, and the number of twists of 180 turns/m, heat-treated at the heat temperature 1000° C.:

(1) Fabrication of Isotropic Pitch-Based Carbon Fiber Mat

High-boiling fraction (so-called ethylene bottom oil) remaining after fractional distillation of olefins such as ethylene, propylene by performing heat decomposition on petroleum naphtha was subjected to a heat treatment at 380° C. and then subjected to distillation under reduced pressure at 320° C. and 10 mmHg abs., thereby obtaining pitch having carbon content percentage of 94.5% by mass, an average molecular weight of 620, and a softening point (with an elevated flow tester) of 170° C.

This pitch was melt-spun by use of two horizontal centrifugal spinning machines having a nozzle diameter of 0.7 mm, the number of nozzles equal to 420, and a ball diameter of 200 mm while setting a process amount per machine equal to 10.8 kg/h (×2 machines), revolutions equal to 800 rpm, and draft wind of 100 m/sec. The spun yarn was sequentially cut out with a cutter and deposited on a belt conveyor, which is traveling at a traveling speed of 1.51 m/min, using a metal mesh of 40 mesh reciprocating in a direction orthogonal to the traveling direction at a proportion of 5 times per minute as a mat having a mat effective width of 700 mm, fiber areal weight of 0.32 kg/m$^2$, a mat thickness of 20 mm, and apparent density of 16 kg/m$^3$, which was an aggregate of short fibers (fiber lengths typically from 100 to 1500 mm) but can be handled as a continuous fiber as the direction of extension of the fiber lengths was preferentially aligned in the traveling direction of the conveyer.

This mat was suspended at a length of 1.5 m on bars having an intervals of 300 mm in an infusibilization furnace having an entire length of 10 m configured to circulate a bar having a width of 2 m at a constant speed of 0.044 m/mm without using a tray. Then, the mat was subjected to infusibilization by flowing circulation gas in the furnace at a velocity of 0.5 m/sec (as a superficial velocity) in a direction orthogonal to an aligned direction of the mat under an atmosphere containing $N0_2$ of 2% and air of the rest, and then by raising a temperature from 100° C. to 250° C. in 3 hours while removing reaction heat.

Subsequently, the mat was baked in a vertical baking furnace, which had dimensions of a total length of 14.8 m (including a cooling part)×a width of 2 m and was configured to process the mat by suspended under its own weight, while raising the temperature thereof up to 1000° C. in 20 minutes. Then, after cooling down to 200° C., the mat was sent out of the furnace.

The obtained carbon fibers heat-treated at the heat temperature of 1000° C. had favorable short-fiber physical properties, namely, the tensile strength of 800 MPa and an elastic modulus in tension of 35 GPa at a fiber diameter of 14.5 μm, without fusion bonding between the fibers (extension percentage of 2.3%).

(2) Carding, Drawing, and Fine Spinning

A 198000-denier sliver was obtained by drafting an isotropic pitch-based carbon fiber mat having a width of 700 mm, a thickness of 20 mm, and 1980000 deniers 10.0 times while aligning the fibers by means of spraying a carbon fiber spinning oil solution ("RW-102"made by Takemoto Oil & Fat Co., Ltd.) in a space between a front roller and a back roller so as to be spread on the carbon fibers at a rate of 2% by mass with a carding machine. Subsequently, two slivers of this type were combined together and drafted to 3.9 times with a first drawing machine to form a single sliver. Then, two slivers of this type were combined together and drafted to 10 times thereof with a second drawing machine to form a single sliver. Moreover, two slivers of this type were combined together and drafted 3.0 times with a third drawing machine to form a single sliver. Furthermore, two slivers of this type were combined together and drafted to 3.0 times with a fourth drawing machine to form a single 9000-denier sliver. This single sliver was drafted 12.0 times thereof with a fine spinning machine, spun at the number of Z (left-handed) twists of 300 turns/m, thereby obtaining 750-denier spun yarn. Subsequently, two threads of this spun yarn are combined together with a twisting machine and doubled at the number of S twists of 180 turns/m, thereby obtaining 1500-denier spun yarn. The tensile strength thereof was equal to 30 N, and the extension percentage thereof was equal to 3.0%.

Reference Example 2

Manufacturing isotropic pitch-based carbon fiber spun yarn of 1500 deniers, and the number of twists of 180 turns/m, heat-treated at the heat temperature of 2000° C.:

The procedures similar to those of Reference Example 1 were conducted except that the sliver obtained by the carding process with the carding machine used in Reference Example 1 was formed into a 198000-denier sliver by performing a heat treatment at 2000° C. for 1 hour in a nitrogen atmosphere. As a result, isotropic pitch-based carbon fiber spun yarn having the tensile strength of 27 N, the extension percentage of 2.6%, and 1500 deniers was obtained.

Reference Example 3

Manufacturing isotropic pitch-based carbon fiber spun yarn of 1500 deniers, and the number of twists of 180 turns/m, heat-treated at the heat temperature of 2400° C.:

The procedures similar to those of Reference Example 1 were conducted except that the sliver obtained by the carding process with the carding machine used in Reference Example 1 was formed into a 198000-denier sliver by performing a heat treatment at 2400° C. for 1 hour in a nitrogen atmosphere. As a result, isotropic pitch-based carbon fiber spun yarn having the tensile strength of 27 N, the extension percentage of 2.6%, and 1500 deniers was obtained.

Reference Example 4

Manufacturing isotropic pitch-based carbon fiber spun yarn of 4000 deniers, and the number of twists of 90 turns/m, heat-treated at the heat temperature of 1000° C.:

The procedures similar to those of Reference Example 1 were conducted except that two 9000-denier slivers obtained by drafting with the fourth drawing machine in Reference Example 1 were combined together, drafted to 4.5 times, spun at the number of Z (left-handed) twists of 90 turns/m by use of a fine spinning machine without a twisting machine. As a result, 4000-denier isotropic pitch-based carbon fiber spun yarn was obtained. The tensile strength thereof was equal to 70 N, and the extension percentage thereof was equal to 2.6%.

Reference Example 5

Manufacturing isotropic pitch-based carbon fiber spun yarn of 4500 deniers, and the number of twists of 90 turns/m, heat-treated at the heat temperature of 2000° C.:

The sliver obtained by the carding process with the carding machine in Reference Example 1 was formed into a 198000-denier sliver by performing a heat treatment at 2000° C. for 1 hour in a nitrogen atmosphere. Subsequently, two slivers of this type were combined together and drafted to 3.9 times with the first drawing machine to form a single sliver. Furthermore, two slivers of this type were combined together and drafted to 10 times with the second drawing machine to form a single sliver. Moreover, two slivers of this type were combined together and drafted to 3.0 times with the third drawing machine to form a single sliver. Furthermore, two slivers of this type were combined together and drafted to 3.0 times with the fourth drawing machine to forma single 9000-denier sliver. This single sliver was drafted to 2.0 times with the fine spinning machine, spun at the number of Z (left-handed) twists of 90 turns/m, thereby obtaining 4500-denier spun yarn. The tensile strength thereof was equal to 78 N, and the extension percentage thereof was equal to 2.6%.

Example 1

The isotropic pitch-based carbon fiber spun yarn of 1500 deniers, and the number of twists of 180 turns/m, heat-treated at the heat temperature of 1000° C. as described in Reference Example 1 was used as a sample material. This isotropic pitch-based carbon fiber spun yarn 10 was wound around the cheese 12 and set on an original yarn supply roller 11 as shown in FIG. 1.

As shown in FIG. 1, the isotropic pitch-based carbon fiber spun yarn 10 extracted from the cheese 12 was allowed to contact an upper part of the touch roller 18, which was configured to render a lower half immersed in the sizing agent tank 14 and to rotate at the same circumferential velocity ($V_R$: 30 m/min) as a velocity ($V_Y$: 30 m/min) of the extracted isotropic pitch-based carbon fiber spun yarn 10, and the isotropic pitch-based carbon fiber spun yarn 10 was extracted again so as to be impregnated with the sizing agent aqueous solution 16 in the sizing agent tank 14 from the surface. The sizing agent layer was thus formed by drying at a drying temperature of 130° C.

Subsequently, the isotropic pitch-based carbon fiber spun yarn 10 including the sizing agent layer formed thereon was wound around the tension roller 22. The wound isotropic pitch-based carbon fiber spun yarn 10 including the sizing agent layer formed thereon did not contain any fine carbon fiber aggregates having the maximum diameter equal to or below 3.0 times of the average diameter of the foundation yarn or the maximum length equal to or below 10 mm. Here, the composition of the sizing agent (A) used therein included polyvinyl alcohol ("Kuraray Poval #218" made by Kuraray) in an amount of 85% by mass, acrylic resin ("Plas Size #663" made by Goo Chemical) in an amount of 5% by mass, a penetrant ("Sanmorin #11" made by Sanyo Chemical Industries) in an amount of 2% by mass, a wax-type oil solution ("Makonol #222" made by Matsumoto Yushi) in an amount of 6% by mass, and water in an amount of 2% by mass.

Subsequently, the isotropic pitch-based carbon fiber spun yarn 10 pulled out of the tension roller 22 was allowed to penetrate the first winding device 24 and the second winding device 26. In the first winding device 24, the bobbin 36 on which the water-soluble polymer vinylon fiber 34 ("Solvron SF type, 84T/24F" made by Nitivy) was rolled was fitted to the spindle 30 and the spindle 30 was rotated at desired revolutions. Accordingly, the water-soluble vinylon fiber 34 pulled out of the bobbin 36 was wound around the isotropic pitch-based carbon fiber spun yarn 10 at a desired number of windings while defining a clearance between lines of the water-soluble vinylon fibers 34, upon passing through the snail wire 28. Here, in terms of characteristics such as thickness, strength, the threads are strongly united and abrasion resistance was drastically improved due to the presence of the water-soluble vinylon fiber 34.

Similarly, in the second winding device 26 as well, the water-soluble vinylon fiber 20 was wound around the isotropic pitch-based carbon fiber spun yarn 10 in the opposite winding direction opposite to that, in which the water-soluble vinylon fiber 34 was wound, the first winding device 24 while defining a clearance between lines of the water-soluble vinylon fibers 20 upon passage through the snail wire 28. Here, the number of windings of the first water-soluble vinylon fiber 34 wound around the isotropic pitch-based carbon fiber spun yarn 10 by the first winding device was set at 800 rounds/m, and the number of windings of the second water-soluble vinylon fiber 20 wound around the isotropic pitch-based carbon fiber spun yarn 10 by the second winding device was set at 800 rounds/m.

Measurement results of the respective numbers of windings of the water-soluble vinylon fibers and the strength regarding the sample material and carbon fiber/vinylon fiber composite yarn for fabric of this example are shown in Table 1.

In addition, this carbon fiber/vinylon fiber composite yarn for fabric was subjected to weaving at 180 rpm by use of a rapier loom. Subsequently, the obtained fabric was subjected to dissolution and removal of the water-soluble vinylon fibers in a bath filled with boiled water of 100° C. so as to satisfy a bath ratio of 1:100 with this fabric, and then the fabric was cleaned in a bath filled with water of 20° C. so as to satisfy a bath ratio of 1:100 with this fabric, and then the fabric was subjected to cleaning in a bath filled with the enzyme-based desizing agent aqueous solution in the amount of 0.05% by mass and at 20° C. so as to satisfy a bath ratio of 1:100 with this fabric. Thereafter, the water-soluble vinylon fibers were dissolved and removed once again in the bath filled with the boiled water at 100° C. so as to satisfy the bath ratio of 1:100 with this fabric, and then the fabric was cleaned in a bath filled with water of 20° C. so as to satisfy a bath ratio of 1:100 with this fabric. Subsequently, the fabric was subjected to primary drying with a cylinder drier at a surface temperature of 130° C., and was subsequently set on a pin tenter and dried at 180° C., thereby obtaining a plain-weave isotropic pitch-based carbon fiber spun yarn fabric. The tensile strength of this isotropic pitch-based carbon fiber spun yarn fabric was shown in Table 1. There was very little dust, no thread breakage, or no emergency shutdown of a loom at the time of weaving.

Example 2

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 3

The procedures similar to those of Example 1 were conducted except that the isotropic pitch-based carbon fiber spun yarn of 1500 deniers, and the number of twists of 180 turns/m baked at the temperature of 2400° C., as described in Reference Example 3 was used instead of the isotropic pitch-based carbon fiber spun yarn of 1500 deniers, and the number of twists of 180 turns/m baked at the temperature of 100°° C., as described in Reference Example 1 as used in Example 1.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 4

The procedures similar to those of Example 1 were conducted except that the isotropic pitch-based carbon fiber spun yarn of 4000 deniers, and the number of twists of 90 turns/m baked at the temperature of 1000° C., as described in Reference Example 4 was used instead of the isotropic pitch-based carbon fiber spun yarn of 1500 deniers, and the number of twists of 180 turns/m baked at the temperature of 1000° C., as described in Reference Example 1 as used in Example 1.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 5

The procedures similar to those of Example 1 were conducted except that the isotropic pitch-based carbon fiber spun yarn of 4500 deniers, and the number of twists of 90 turns/m baked at the temperature of 2000° C., as described in Reference Example 5 was used instead of the isotropic pitch-based carbon fiber spun yarn of 1500 deniers, and the number of twists of 180 turns/m baked at the temperature of 1000° C., as described in Reference Example 1 as used in Example 1.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 6

The isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1. As the method of impregnating the sizing agent aqueous solution, an air flow at a linear velocity of 20 m/sec was blown over the extracted isotropic pitch-based carbon fiber spun yarn instead of using the touch roller 18 rotated at the same circumferential velocity as the velocity ($V_Y$: 30 m/min) of the extracted isotropic pitch-based carbon fiber spun yarn 10 as described in Example 1, thereby removing the fine carbon fibers.

Subsequently, the spun yarn was dried at a drying temperature of 130° C. after spraying the sizing agent aqueous solution by use of a spray. As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 7

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from method by using the touch roller 18 rotated at the same circumferential velocity as the velocity of the extracted isotropic pitch-based carbon fiber spun yarn 10 as described in Example 1 to a method by dipping the extracted isotropic pitch-based carbon fiber spun yarn 10 into water ($V_Y$: 15 m/min, the retention time in the water tank: 10 sec), then pulling it out to the air, removing excessive moisture by blowing an air flow (a linear velocity: 20 m/min), subsequently drying it at a drying temperature of 130° C., then spraying and drying the sizing agent aqueous solution over the spun yarn by use of a spray to form the sizing agent layer.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 8

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using rotated at the same circumferential velocity as the velocity of the extracted isotropic pitch-based carbon fiber spun yarn 10 as described in Example 1 to a method by dipping the extracted isotropic pitch-based carbon fiber spun yarn 10 into water while applying an ultrasonic wave thereto ($V_Y$: 15 m/min, the retention time in the water tank: 10 sec, the ultrasonic wave having a frequency of 40 kHz and an output of 300 W), then pulling it out to the air, removing excessive moisture by blowing an air flow (a linear velocity: 20 m/min), subsequently drying it at a drying temperature of 130° C., then spraying and drying the sizing agent aqueous solution over the spun yarn by use of a spray to form the sizing agent layer.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained.

Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 9

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 rotated at the same circumferential velocity as the velocity of the extracted isotropic pitch-based carbon fiber spun yarn 10 as described in Example 1 to a method by dipping the extracted isotropic pitch-based carbon fiber spun yarn 10 into water while applying an ultrasonic wave thereto ($V_Y$: 15 m/min, the retention time in the water tank: 10 sec, the ultrasonic wave having a frequency of 40 kHz and the output of 300 W), then pulling it out to the air, removing excessive moisture by blowing an air flow (a linear velocity: 20 m/min), subsequently drying it at a drying temperature of 130° C., then dripping the sizing agent aqueous solution over the spun yarn by use of a dripping nozzle, and drying the spun yarn at a drying temperature of 130° C. to form the sizing agent layer.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 10

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 rotated at the same circumferential velocity as the velocity of the extracted isotropic pitch-based carbon fiber spun yarn 10 as described in Example 1 to the method by using the touch roller 18 rotated at a circumferential velocity ($V_R$: 60 m/min) 2.0 times as fast as the velocity of the extracted isotropic pitch-based carbon fiber spun yarn 10.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 11

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 rotated at the same circumferential velocity as the velocity ($V_Y$: 30 m/min) of the extracted isotropic pitch-based carbon fiber spun yarn 10 as described in Example 1 to the touch roller 18 to be rotated at a circumferential velocity ($V_R$: 90 m/min) 3.0 times as fast as the velocity of the extracted isotropic pitch-based carbon fiber spun yarn 10.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 12

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the sizing agent was replaced with an aqueous solution composed of polyvinyl alcohol ("Kuraray Poval #217" made by Kuraray) in an amount of 70% by mass and water in an amount of 30% by mass was used for a sizing agent(B).

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 13

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the number of windings applied to the first water-soluble vinylon fiber and the number of windings applied to the second water-soluble vinylon fiber were changed from 800 rounds/m to 200 rounds/m and from 800 rounds/m to 200 rounds/m, respectively.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 14

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the number of windings applied to the first water-soluble vinylon fiber and the number of windings applied to the second water-soluble vinylon fiber were changed from 800 rounds/m to 1800 rounds/m and from 800 rounds/m to 1800 rounds/m, respectively.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Example 15

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the second water-soluble vinylon fiber was not wound thereon.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, and emergency shutdown of a loom incurred 0.5 times/hour, at the time of weaving.

Example 16

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that instead of the number of windings 800 rounds/m applied to the first water-soluble vinylon fiber and the number of windings 800 rounds/m applied to the second water-soluble vinylon fiber, the number of windings of the first water-soluble vinylon fiber was set at 4000 rounds/m so as to be wound without providing clearances between the vinylon fiber lines while the second water-soluble vinylon fiber was not wound thereon.

As a result, isotropic pitch-based carbon fiber spun yarn including the sizing agent layer formed thereon with no fine carbon fiber aggregates having the maximum diameter exceeding 3.0 times of the average diameter of the foundation yarn or the maximum length exceeding 10 mm was obtained. Moreover, a plain weave isotropic pitch-based carbon fiber spun yarn fabric was obtained. Various physical properties thereof are shown in Table 1. There was very little dust, no thread breakage, or no emergency shutdown of a loom at the time of weaving.

Comparative Example 1

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 to be rotated at the same circumferential velocity as the velocity of the extracted isotropic pitch-based carbon fiber spun yarn 10 as described in Example 1 to a method by dipping the extracted isotropic pitch-based carbon fiber spun yarn 10 into the sizing agent aqueous solution, then pulling it out to the air, removing excessive sizing agent aqueous solution by allowing the spun yarn to contact a guide, and then drying it to form the sizing agent layer.

As a result, isotropic pitch-based carbon fiber spun yarn including the sizing agent layer formed thereon with the fine carbon fiber aggregates having the maximum diameter exceeding 3.0 times of the average diameter of the foundation yarn or the maximum length exceeding 10 mm in the amount of 7 pieces per 10 m was obtained. Subsequently, there was an attempt to weave the carbon fiber/vinylon fiber composite yarn thus obtained at 180 rpm by use of a rapier loom. However, there was a huge amount of soaring dust and emergency shutdown of the loom not attributable to thread breakage occurred 5 or more times per hour and thread breakage occurred 5 or more times per hour. Accordingly, it was difficult to weave.

Comparative Example 2

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 to be rotated at the same circumferential velocity as the velocity of the extracted isotropic pitch-based carbon fiber spun yarn 10 as described in Example 1 to a method by dipping the extracted isotropic pitch-based carbon fiber spun yarn 10 into the sizing agent aqueous solution, then pulling it out to the air, removing excessive sizing agent aqueous solution by allowing the spun yarn to pass through a vertically arranged pair of rollers rotated at the same circumferential velocity as the velocity of the spun yarn 10, and drying it to form the sizing agent layer.

As a result, isotropic pitch-based carbon fiber spun yarn including the sizing agent layer formed thereon with the fine carbon fiber aggregates having the maximum diameter exceeding 3.0 times of the average diameter of the foundation yarn or the maximum length exceeding 10 mm in the amount of 2 pieces per 10 m was obtained. Subsequently, there was an attempt to weave the carbon fiber/vinylon fiber composite yarn thus obtained at 180 rpm by use of a rapier loom. However, there was a huge amount of soaring dust and emergency shutdown of the loom not attributable to thread breakage occurred 2 or 3 times per hour and thread breakage occurred 1 or 2 times per hour. Accordingly, it was difficult to weave.

Comparative Example 3

There was an attempt to weave the isotropic pitch-based carbon fiber spun yarn of 1500 deniers, and the number of twists of 180 turns/m baked at the temperature of 2000° C., as described in Reference Example 2 by use of a rapier loom without impregnating the sizing agent aqueous solution and also winding the water-soluble vinylon fibers.

This isotropic pitch-based carbon fiber spun yarn included the fine carbon fiber aggregates having the maximum diameter exceeding 3.0 times of the average diameter of the foundation yarn or the maximum length exceeding 10 mm in the amount of 1 piece/10 m. Fluff was easily generated as the composite yarn did not include the sizing agent layer, and there was a huge amount of soaring dust of the isotropic pitch-based carbon fibers caused by fluff being broken at the time of weaving. Emergency shutdown of the loom not attributable to reasons other than thread breakage occurred 5 or more times per hour. Moreover, thread breakage frequently occurred (5 or more times per hour) due to the low tensile strength of the spun yarn which was equivalent to 27 N. Accordingly, it was difficult to weave.

Comparative Example 4

Until isotropic pitch-based carbon fiber/vinylon fiber composite yarn was obtained, the procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 rotated at the same circumferential velocity as the velocity ($V_Y$: 30 m/min) of the extracted isotropic pitch-based carbon fiber spun yarn 10 as described in Example 1 to the touch roller 18 to be rotated at a circumferential velocity ($V_R$: 15 m/min) ½ times as fast as the velocity of the extracted isotropic pitch-based carbon fiber spun yarn 10.

As a result, isotropic pitch-based carbon fiber spun yarn including the sizing agent layer formed thereon with the fine carbon fiber aggregates having the maximum diameter exceeding 3.0 times of the average diameter of the foundation yarn or the maximum length exceeding 10 mm in the amount of 2 pieces per 10 m was obtained. Subsequently, there was an attempt to weave the carbon fiber/vinylon fiber composite yarn thus obtained at 180 rpm by use of a rapier loom. However, there was a huge amount of soaring dust and emergency shutdown of the loom not attributable to thread breakage occurred 2 or 3 times per hour and thread breakage occurred 1 or 2 times per hour. Accordingly, it was difficult to weave.

Comparative Example 5

Until obtaining isotropic pitch-based carbon fiber/vinylon fiber composite yarn, the procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 to be rotated at the same circumferential velocity as the velocity ($V_Y$: 30 m/min) of the extracted isotropic pitch-based carbon fiber spun yarn 10 as described in Example 1 to a method by using the touch roller 18 to be rotated at a circumferential velocity ($V_R$: 3 m/min) 1/10 times as fast as the velocity of the extracted isotropic pitch-based carbon fiber spun yarn 10.

As a result, isotropic pitch-based carbon fiber spun yarn including the sizing agent layer formed thereon with the fine carbon fiber aggregates having the maximum diameter exceeding 3.0 times of the average diameter of the foundation yarn or the maximum length exceeding 10 mm in the amount of 3 pieces per 10 m was obtained. Subsequently, there was an attempt to weave the carbon fiber/vinylon fiber composite yarn thus obtained at 180 rpm by use of a rapier loom. However, there was a huge amount of soaring dust and emergency shutdown of the loom not attributable to thread breakage occurred 4 or 5 times per hour and thread breakage occurred 3 or 4 times per hour. Accordingly, it was difficult to weave.

Comparative Example 6

Until obtaining isotropic pitch-based carbon fiber/vinylon fiber composite yarn, the procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, and that the method of impregnating the sizing agent aqueous solution was changed from the method by using the touch roller 18 to be rotated at the same circumferential velocity as the velocity ($V_Y$: 30 m/min) of the extracted isotropic pitch-based carbon fiber spun yarn 10 as described in Example 1 to a method by using the touch roller 18 to be rotated at a circumferential velocity (VR: 0.3 m/min) 1/100 times as fast as the velocity of the extracted isotropic pitch-based carbon fiber spun yarn 10.

As a result, isotropic pitch-based carbon fiber spun yarn including the sizing agent layer formed thereon with the fine carbon fiber aggregates having the maximum diameter exceeding 3.0 times of the average diameter of the foundation yarn or the maximum length exceeding 10 mm in the amount of 2 pieces per 10 m was obtained. Subsequently, there was an attempt to weave the carbon fiber/vinylon fiber composite yarn thus obtained at 180 rpm by use of a rapier loom. However, there was a huge amount of soaring dust and emergency shutdown of the loom not attributable to thread breakage occurred 5 or more times per hour and thread breakage occurred 4 or 5 times per hour. Accordingly, it was difficult to weave.

Comparative Example 7

The procedures similar to those of Example 1 were conducted except that the isotropic pitch-based carbon fiber spun yarn of 1500 deniers, and the number of twists of 180 turns/m baked at the temperature of 2000° C., as described in Reference Example 2 was used instead of the isotropic pitch-based carbon fiber spun yarn of 1500 deniers, and the number of twists of 180 turns/m baked at the temperature of 1000° C., as described in Reference Example 1 as used in Example 1, that the method of impregnating the sizing agent aqueous solution was changed from the method by using the touch roller 18 to be rotated at the same circumferential velocity as the velocity of the extracted isotropic pitch-based carbon fiber spun yarn 10 as described in Example 1 to the method by dipping the extracted isotropic pitch-based carbon fiber spun yarn 10 into the sizing agent aqueous solution, then pulling it out to the air, removing the excessive sizing agent aqueous solution by allowing the spun yarn to contact the guide, and then drying the spun yarn to form the sizing agent layer, and that instead of the number of windings 800 rounds/m applied to the first water-soluble vinylon fiber and the number of windings 800 rounds/m applied to the second water-soluble vinylon fiber, the number of windings of the first water-soluble vinylon fiber was set at 4000 rounds/m in terms so as to be wound without providing clearances between the vinylon fiber lines while the second water-soluble vinylon fiber was not wound thereon.

As a result, isotropic pitch-based carbon fiber spun yarn including the sizing agent layer formed thereon with the fine carbon fiber aggregates having the maximum diameter exceeding 3.0 times of the average diameter of the foundation yarn or the maximum length exceeding 10 mm in the amount of 2 pieces per 10 m was obtained. Subsequently, there was an attempt to weave the carbon fiber/vinylon fiber composite yarn thus obtained at 180 rpm by use of a rapier loom. Various physical properties thereof are shown in Table 1. There was very little dust, no thread breakage, or no emergency shutdown of a loom at the time of weaving. However, some portions where carbon fiber spun yarn was broken were observed in the fabric after removing the sizing agent and the water-soluble vinylon fiber.

TABLE 1

| | Carbon Fiber Spun Yarn | | | | | | | | | |
|---|---|---|---|---|---|---|---|---|---|---|
| | | | | | | Fine Carbon Fiber Aggregate | | | | |
| | Heat Treatment | | Method of | Sizing Agent | | Velocity | Maximum | Maximum | Number of aggregates having diameter exceeding 3 times or length exceeding 10 mm | Number of aggregates having diameter ranging from 1.5 to 3.0 times and length ranging from 3 to 10 |
| | Temperature ° C. | Fineness (deniers) | removing fine carbon fibers | Blend Type | Impregnation Method | Ratio (Vr/Vy) | Diameter (times) | Length (mm) | (pieces per 10 m) | mm (pieces per 10 m) |
| Example 1 | 1000 | 1500 | Touch Roller | A | Touch Roller | 1.0 | 2.2 | 4.4 | 0 | 1 |
| Example 2 | 2000 | 1500 | Touch Roller | A | Touch Roller | 1.0 | 1.4 | 3.8 | 0 | 1 |
| Example 3 | 2400 | 1500 | Touch Roller | A | Touch Roller | 1.0 | 1.4 | 3.8 | 0 | 1 |
| Example 4 | 1000 | 4000 | Touch Roller | A | Touch Roller | 1.0 | 2.2 | 4.2 | 0 | 2 |
| Example 5 | 2000 | 4500 | Touch Roller | A | Touch Roller | 1.0 | 2.2 | 4.2 | 0 | 2 |
| Example 6 | 2000 | 1500 | Air Flow | A | Splaying | — | 1.6 | 4.2 | 0 | 2 |
| Example 7 | 2000 | 1500 | Water Washing | A | Splaying | — | 1.7 | 4.0 | 0 | 4 |
| Example 8 | 2000 | 1500 | Ultrasonic/ Water Washing | A | Splaying | — | 1.5 | 4.0 | 0 | 1 |
| Example 9 | 2000 | 1500 | Ultrasonic/ Water Washing | A | Dripping | — | 1.5 | 4.0 | 0 | 1 |
| Example 10 | 2000 | 1500 | Touch Roller | A | Touch Roller | 2.0 | 1.4 | 3.8 | 0 | 1 |
| Example 11 | 2000 | 1500 | Touch Roller | A | Touch Roller | 3.0 | 1.3 | 3.6 | 0 | 1 |

TABLE 1-continued

| | | | | | | | | | | |
|---|---|---|---|---|---|---|---|---|---|---|
| Example 12 | 2000 | 1500 | Touch Roller | B | Touch Roller | 1.0 | 1.4 | 3.8 | 0 | 1 |
| Example 13 | 2000 | 1500 | Touch Roller | A | Touch Roller | 1.0 | 1.4 | 3.8 | 0 | 1 |
| Example 14 | 2000 | 1500 | Touch Roller | A | Touch Roller | 1.0 | 1.4 | 3.8 | 0 | 1 |
| Example 15 | 2000 | 1500 | Touch Roller | A | Touch Roller | 1.0 | 1.4 | 3.8 | 0 | 1 |
| Example 16 | 2000 | 1500 | Touch Roller | A | Touch Roller | 1.0 | 1.4 | 3.8 | 0 | 1 |
| Comparative Example 1 | 2000 | 1500 | Guide | A | Dipping | — | 6.5 | 13.4 | 7 | 6 |
| Comparative Example 2 | 2000 | 1500 | Roller | A | Dipping | 1.0 | 5.0 | 11.3 | 2 | 5 |
| Comparative Example 3 | 2000 | 1500 | — | — | — | — | 5.1 | 11.6 | 1 | 4 |
| Comparative Example 4 | 2000 | 1500 | Touch Roller | A | Touch Roller | 0.5 | 4.6 | 12.0 | 2 | 5 |
| Comparative Example 5 | 2000 | 1500 | Touch Roller | A | Touch Roller | 0.1 | 6.8 | 13.1 | 3 | 6 |
| Comparative Example 6 | 2000 | 1500 | Touch Roller | A | Touch Roller | 0.01 | 7.2 | 16.4 | 3 | 6 |
| Comparative Example 7 | 2000 | 1500 | Guide | A | Dipping | 1.0 | 5.0 | 11.3 | 2 | 5 |

| | Carbon Fiber/Vinylon Fiber Composite Yarn | | | | High-speed Weaving | | Carbon Fiber Spun Yarn Textile | |
|---|---|---|---|---|---|---|---|---|
| | Number of windings of First Water-soluble Vinylon Fiber (rounds/m) | Number of winding of Second Water-soluble Vinylon Fiber (rounds/m) | Strength and Elongation: Tensile Strength (N) | Strength and Elongation: Elongation Percentage (%) | Thread Breakage Frequency (times/hour) | Emergency Shutdown Frequency (times/hour) | Tensile Strength (kN per 50-mm width): Warp direction | Tensile Strength (kN per 50-mm width): Weft direction |
| Example 1 | 800 | 800 | 250 | 3.2 | 0 | 0 | 0.58 | 0.49 |
| Example 2 | 800 | 800 | 240 | 3.1 | 0 | 0 | 0.55 | 0.47 |
| Example 3 | 800 | 800 | 230 | 2.9 | 0 | 0 | 0.56 | 0.48 |
| Example 4 | 800 | 800 | 420 | 3.4 | 0 | 0 | 1.55 | 1.31 |
| Example 5 | 800 | 800 | 425 | 3.3 | 0 | 0 | 1.65 | 1.41 |
| Example 6 | 800 | 800 | 240 | 3.1 | 0 | 0 | 0.55 | 0.47 |
| Example 7 | 800 | 800 | 240 | 3.0 | 0 | 0 | 0.55 | 0.47 |
| Example 8 | 800 | 800 | 240 | 3.1 | 0 | 0 | 0.55 | 0.47 |
| Example 9 | 800 | 800 | 236 | 3.0 | 0 | 0 | 0.55 | 0.47 |
| Example 10 | 800 | 800 | 240 | 3.1 | 0 | 0 | 0.55 | 0.47 |
| Example 11 | 800 | 800 | 240 | 3.1 | 0 | 0 | 0.55 | 0.47 |
| Example 12 | 800 | 800 | 240 | 3.1 | 0 | 0 | 0.55 | 0.47 |
| Example 13 | 200 | 200 | 155 | 2.7 | 0 | 0 | 0.55 | 0.47 |
| Example 14 | 1800 | 1800 | 280 | 3.2 | 0 | 0 | 0.55 | 0.47 |
| Example 15 | 800 | — | 175 | 3.1 | 0 | 0.5 | 0.55 | 0.47 |
| Example 16 | 4000 | — | 320 | 3.3 | 0 | 0 | 0.48 | 0.45 |
| Comparative Example 1 | 800 | 800 | 240 | 3.1 | >5 | >5 | — | — |
| Comparative Example 2 | 800 | 800 | 240 | 3.1 | 1 to 2 | 2 to 3 | — | — |
| Comparative Example 3 | — | — | 27 | 2.6 | >5 | >5 | — | — |
| Comparative Example 4 | 800 | 800 | 240 | 3.1 | 1 to 2 | 2 to 3 | — | — |
| Comparative Example 5 | 800 | 800 | 240 | 3.1 | 3 to 4 | 4 to 5 | — | — |
| Comparative Example 6 | 800 | 800 | 240 | 3.1 | 4 to 5 | >5 | — | — |
| Comparative Example 7 | 4000 | — | 320 | 3.3 | 0 | 0 | — | — |

Example 17

The isotropic pitch-based carbon fiber spun yarn obtained in Reference Example 1 was processed with a method by only blowing an air flow as shown in FIG. 4, and thus the fine carbon fibers attached to the surface of the carbon fiber spun yarn was removed. On this occasion, the feeding speed of the spun yarn was set at 30 m/min and the linear velocity of the air flow was set at 20 m/sec. The strength and weights of the isotropic pitch-based carbon fiber spun yarn respectively before and after these preprocesses were measured and a weight reduction rate was calculated by use of the formula below, and the results are shown in Table 2 together with the strength.

$$\text{Weight reduction rate}=\{(W_1-W_0)/W_1\}\times 100(\%\text{ by mass}) \quad (1)$$

$W_1$: Absolute dry mass of the spun yarn before blowing the air flow $W_0$: Absolute dry mass of the spun yarn after blowing the air flow Example 18

The isotropic pitch-based carbon fiber spun yarn obtained in Reference Example 1 was processed with a method of washing with water, blowing an air flow, and then drying as shown in FIG. 5, and thus the fine broken carbon fibers attached to the surface of the carbon fiber spun yarn was removed. On this occasion, the feeding speed of the spun yarn was set at 15 m/min, the retention time thereof in the water tank was set at 10 seconds, the linear velocity of the air flow was set at 20 m/sec, and the drying temperature was set at 130° C. The strengths and weights of the isotropic pitch-based carbon fiber spun yarn respectively before and after these preprocesses were measured and thus a weight reduction rate was calculated by use of the formula below, and the results are shown in Table 2 together with the strength.

$$\text{Weight reduction rate}=\{(W_1-W_0)/W_1\}\times 100(\%\text{ by mass}) \quad (2)$$

$W_1$: Absolute dry mass of the spun yarn before water washing
$W_0$: Absolute dry mass of the spun yarn after water washing Example 19

The isotropic pitch-based carbon fiber spun yarn obtained in Reference Example 1 was processed with a method of washing with water while applying an ultrasonic wave, subsequently blowing an air flow, and then drying as shown in FIG. 6, and thus the fine carbon fibers attached to the surface of the carbon fiber spun yarn was removed. On this occasion, the feeding speed of the spun yarn was set at 15 m/min, the retention time thereof in the water tank was set at 10 seconds (the ultrasonic frequency of 40 kHz and the output of 300 W), the linear velocity of the air flow was set at 20 m/sec, and the drying temperature was set at 130° C. The strengths and weights of the isotropic pitch-based carbon fiber spun yarn respectively before and after these preprocesses were measured and a weight reduction rate was calculated by use of the formula below, and the results are shown in Table 2 together with the strength.

TABLE 2

| | Before processing | | | After processing | | | |
|---|---|---|---|---|---|---|---|
| | Strength and elongation | | | Strength and elongation | | | Mass |
| | Tensile strength (N) | Elongation percentage (%) | Deniers (D) | Tensile strength (N) | Elongation percentage (%) | Deniers (D) | reduction rate (% by mass) |
| Example 17 | 30 | 3.0 | 1500 | 30 | 3.0 | 1496 | 2.2 |
| Example 18 | 30 | 3.0 | 1500 | 30 | 3.0 | 1480 | 1.4 |
| Example 19 | 30 | 3.0 | 1500 | 30 | 3.0 | 1477 | 1.4 |

Weight reduction rate = $\{(W_1 - W_0/W_1\} \times 100$ (% by mass) (3)
$W_1$: Absolute dry mass of the spun yarn before water washing
$W_0$: Absolute dry mass of the spun yarn before water washing

INDUSTRIAL APPLICABILITY

According to the present invention, it is possible to achieve high-speed weaving since thread breakage at the time of high-speed weaving is sufficiently prevented from occurring. Moreover, it is also possible to improve a work environment since dust at the time of manufacturing is prevented from being generated.

The invention claimed is:

1. An isotropic pitch-based carbon fiber spun yarn fabric produced by a process comprising:

winding a water-soluble polymer fiber around a surface of an isotropic pitch-based carbon fiber spun yarn to form a composite yarn;

weaving the composite yarn to form a composite yarn fabric; and dissolving and removing the water-soluble polymer fiber from the composite yarn fabric, wherein the water-soluble polymer fiber comprises:

a first water-soluble polymer fiber wound around the surface of the spun yarn by twisting the first water-soluble polymer fiber in a first direction with gaps provided between the fibers; and a second water-soluble polymer fiber wound around the surface of the spun yarn by twisting a second water-soluble polymer fiber in the second direction opposite to the first direction with gaps provided between the fibers.

2. The isotropic pitch-based carbon fiber spun yarn fabric according to claim 1, wherein the composite yarn further comprises a sizing agent layer formed on the surface of the spun yarn, and isotropic pitch-based carbon fiber spun yarn fabric being produced by the process characterized further comprising:

dissolving and removing the water-soluble polymer fiber and the sizing agent from the composite yarn fabric.

3. The isotropic pitch-based carbon fiber spun yarn fabric according to claim 1, wherein the water-soluble polymer fiber is a water-soluble vinylon fiber.

4. The isotropic pitch-based carbon fiber spun yarn fabric according to claim 1, wherein the isotropic pitch-based carbon fiber spun yarn contains fine carbon fiber aggregates having a maximum diameter equal to or below 3.0 times an average diameter of foundation yarn of the spun yarn and a maximum length equal to or below 10 mm.

5. The isotropic pitch-based carbon fiber spun yarn fabric according to claim 4, wherein the isotropic pitch-based carbon fiber spun yarn satisfies an abundance ratio of the fine carbon fiber aggregates contained in the isotropic pitch-based carbon fiber spun yarn, which is equal to or below 3 pieces per 10 m, the fine carbon fiber aggregates having the maximum diameter in a range of 1.5 to 3.0 times the average diameter of the foundation yarn of the spun yarn and the maximum length in a range of 3 to 10 mm.

6. A method of manufacturing an isotropic pitch-based carbon fiber spun yarn fabric, comprising the steps of:

obtaining composite yarn by winding a water-soluble polymer fiber around a surface of isotropic pitch-based carbon fiber spun yarn;

obtaining a composite yarn fabric by weaving the composite yarn; and obtaining the isotropic pitch-based carbon fiber spun yarn fabric by dissolving and removing the water-soluble polymer fiber from the composite yarn fabric, wherein the step of obtaining the composite yarn comprises:

winding a first water-soluble polymer fiber wound around the surface of the spun yarn by twisting the first water-soluble polymer fiber in a first direction with gaps provided between the fibers; and winding a second water-soluble polymer fiber around the surface of the spun yarn by twisting a second water-soluble polymer fiber in the second direction opposite to the first direction with gaps provided between the fibers.

7. The method of manufacturing the isotropic pitch-based carbon fiber spun yarn fabric according to claim 6, further comprising the step of:

forming a sizing agent layer by applying and then drying a sizing agent aqueous solution onto the surface of the spun yarn, the step of obtaining the isotropic pitch-based carbon fiber spun yarn fabric, characterized in that the water-soluble polymer fiber and the sizing agent are dissolved and removed from the composite yarn fabric in the step of obtaining the isotropic pitch-based carbon fiber spun yarn fabric.

8. The method of manufacturing the isotropic pitch-based carbon fiber spun yarn fabric according to claim 6, wherein the water-soluble polymer fiber is a water-soluble vinylon fiber.

9. The method of manufacturing the isotropic pitch-based carbon fiber spun yarn fabric according to claim 6, further comprising the step of:

removing fine carbon fibers and aggregates thereof from the isotropic pitch-based carbon fiber spun yarn and thus obtaining the spun yarn containing the fine carbon fiber aggregates having a maximum diameter equal to or below 3.0 times an average diameter of foundation yarn of the spun yarn and a maximum length equal to or below 10 mm.

10. The method of manufacturing the isotropic pitch-based carbon fiber spun yarn fabric according to claim 9, wherein the isotropic pitch-based carbon fiber spun yarn obtained in the foregoing step satisfies an abundance ratio of the fine carbon fiber aggregates contained in the spun yarn, which is equal to or below 3 pieces per 10 m, the fine carbon fiber aggregates having the maximum diameter in a range of 1.5 to 3.0 times the average diameter of the foundation yarn of the spun yarn and the maximum length in a range of 3 to 10 mm.

11. The method of manufacturing the isotropic pitch-based carbon fiber spun yarn fabric according to claim 9, the foregoing step is at least one process selected from the group consisting of the following (a) to (d):

(a) a process of allowing the spun yarn to contact a roller rotating in the same direction as a traveling direction of the spun yarn at a circumferential velocity equal to or greater than a feeding velocity of the spun yarn;

(b) a process of blowing an air flow over the spun yarn;

(c) a process of washing the spun yarn with water; and (d) a process of washing the spun yarn with water while applying an ultrasonic wave.

12. A composite yarn comprising:

isotropic pitch-based carbon fiber spun yarn; and a water-soluble polymer fiber wound around a surface of the spun yarn, wherein the water-soluble polymer fiber comprises:

a first water-soluble polymer fiber wound around the surface of the spun yarn by twisting the first water-soluble polymer fiber in a first direction with gaps provided between the fibers; and a second water-soluble polymer fiber wound around the surface of the spun yarn by twisting a second water-soluble polymer fiber in the second direction opposite to the first direction with gaps provided between the fibers.

13. The composite yarn according to claim 12, further comprising:

a sizing agent layer formed on the surface of the spun yarn.

14. The composite yarn according to claim 12, wherein the water-soluble polymer fiber is a water soluble vinylon fiber.

15. The composite yarn according to claim 12, wherein the isotropic pitch-based carbon fiber spun yarn contains fine carbon fiber aggregates having a maximum diameter equal to or below 3.0 times an average diameter of foundation yarn of the spun yarn and a maximum length equal to or below 10 mm.

16. The composite yarn according to claim 15, wherein the isotropic pitch-based carbon fiber spun yarn satisfies an abundance ratio of the fine carbon fiber aggregates contained in the isotropic pitch-based carbon fiber spun yarn, which is equal to or below 3 pieces per 10 m, the fine carbon fiber aggregates having the maximum diameter in a range of 1.5 to 3.0 times the average diameter of the foundation yarn and the maximum length in a range of 3 to 10 MM.

17. Isotropic pitch-based carbon fiber spun yarn, wherein fine carbon fiber aggregates, which are contained in the isotropic pitch-based carbon fiber spun yarn, have a maximum diameter equal to or below 3.0 times of an average diameter of foundation yarn of the spun yarn and a maximum length equal to or below 10 mm.

18. The isotropic pitch-based carbon fiber spun yarn according to claim 17, wherein the isotropic pitch-based carbon fiber spun yarn satisfies an abundance ratio of the fine carbon fiber aggregates contained in the isotropic pitch-based carbon fiber spun yarn, which is equal to or below 3 pieces per 10 m, the fine carbon fiber aggregates having the maximum diameter in a range of 1.5 to 3.0 times the average diameter of the foundation yarn of the spun yarn and the maximum length in a range of 3 to 10 mm.

19. A method of manufacturing isotropic pitch-based carbon fiber spun yarn comprising the steps of:

removing fine carbon fibers and aggregates thereof by at least one process selected from the group consisting of the following (a) to (d):

(a) a process of allowing the spun yarn to contact a roller rotating in the same direction as a traveling direction of the spun yarn at a circumferential velocity equal to or greater than a feeding velocity of the spun yarn;

(b) a process of blowing an air flow over the spun yarn;

(c) a process of washing the spun yarn with water; and (d) a process of washing the spun yarn with water while applying an ultrasonic wave, and obtaining the spun yarn containing the fine carbon fiber aggregates having a maximum diameter equal to or below 3.0 times of an average diameter of foundation yarn of the spun yarn and a maximum length equal to or below 10 mm.

20. The method of manufacturing the isotropic pitch-based carbon fiber spun yarn according to claim 19, wherein the isotropic pitch-based carbon fiber spun yarn to be obtained satisfies an abundance ratio of the fine carbon fiber aggregates contained in the spun yarn, which is equal to or below 3 pieces per 10 m, the fine carbon fiber aggregates having the maximum diameter in a range of 1.5 to 3.0 times as large as the average diameter of the foundation yarn and the maximum length in a range of 3 to 10 mm.

* * * * *